United States Patent [19]

Stafford

[11] 4,013,030

[45] Mar. 22, 1977

[54] SUPPORT FOR LNG SHIP TANKS

[75] Inventor: Donald Claude Stafford, Hinsdale, Ill.

[73] Assignee: Chicago Bridge & Iron Company, Oak Brook, Ill.

[22] Filed: Feb. 26, 1976

[21] Appl. No.: 661,776

[52] U.S. Cl. ..... 114/74 A; 220/9 LG

[51] Int. Cl.[2] ..... B63B 25/16

[58] Field of Search ..... 114/74 A, 74 R; 220/9 LG, 14, 15

[56] References Cited

UNITED STATES PATENTS

| | | | |
|---|---|---|---|
| 2,706,575 | 4/1955 | Soherr | 220/15 |
| 3,011,321 | 12/1961 | Clauson | 114/74 A |
| 3,380,611 | 4/1968 | Brougham et al. | 220/15 |
| 3,425,583 | 2/1969 | Bridges | 114/74 A |
| 3,583,351 | 6/1971 | Gorman | 114/74 A |
| 3,853,240 | 12/1974 | Alleaume | 220/9 LG |
| 3,908,574 | 9/1975 | Miller et al. | 114/74 R |

*Primary Examiner*—Trygve M. Blix
*Assistant Examiner*—Stuart M. Goldstein
*Attorney, Agent, or Firm*—Merriam, Marshall, Shapiro & Klose

[57] ABSTRACT

In combination, a tank and a support system located about a circular horizontal section of the tank, the support system comprising a plurality of essentially identical composite supporting units spaced around the circular horizontal section, with each said supporting unit being joined to the tank and to a base, each supporting unit having a vertical key with radial contact faces located between and in slidable contact with a pair of opposing vertical faces of a keyway, each supporting unit having a vertical coupling comprising a sleeve with a cylindrical element located therein, with either the sleeve or the cylindrical element being stationary and the other being rotatable about a vertical axis during assembly of the support system, the vertical key or the keyway being joined to whichever of the sleeve or the cylindrical element is rotatable during assembly and the other of the vertical key or keyway is joined to the base.

14 Claims, 12 Drawing Figures

SUPPORT FOR LNG SHIP TANKS

This invention relates to storage tanks and support systems for such tanks. More particularly, this invention is concerned with a novel combination of tank and support system therefor which holds the tank securely yet permits horizontal dimensional change of the tank with change in temperature, such as due to a product stored therein at a temperature substantially above or below ambient temperature.

For many years products have been stored in tanks on land and have been transported in tanks in ships. Until relatively recently, most materials stored or transported in tanks have been at ambient temperature. Support systems for such tanks did not present serious problems since no substantial dimensional changes resulted in either the tanks or the support systems.

Within the last few years it has become quite common to store and transport products at temperatures substantially above or below ambient temperature. The wide temperature ranges involved cause the tanks used to expand and contract substantially and the dimensional changes have required special tank support systems. This problem is most severe with ship tanks although land based tanks involve similar, but fewer, problems.

Ship tanks used for transporting refrigerated liquid cargoes contract during initial filling when the tank temperature is lowered from ambient to the refrigeration temperature of the product during transport and expand when the tanks are empty and are allowed to return to ambient temperature. The contraction and expansion of the tank must be accommodated to prevent stresses from developing which lead to failure of the tank or the surrounding ship structure. Not only must the contraction and expansion of the tank be accommodated but, in addition, the tank must be firmly supported in the ship so that it is not damaged through the action of sea conditions which a ship can be expected to meet during a voyage. The support system must be capable of transmitting the horizontal (parallel to the ship deck) and vertical (normal to the ship deck) forces to the ship structure and still permit expansion and contraction of the tank. It is also important for some uses that the tank support system insulate against undue heat transfer from the ship to the tank.

Miller et al. U.S. Pat. No. 3,908,574 discloses a spherical tank and support system therefor in a ship. To accommodate temperature-induced tank dimensional change a sliding radial key support system is used. For the support system to perform as intended it is important that each key and companion keyway be precisely located radial to the tank and in the same horizontal plane to evenly distribute the load. Because of the large size of the tanks it is difficult, time consuming and costly to fabricate tank support system structures as disclosed therein with the necessary precision. There is accordingly a need for an improved combination of tank and support system therefor which utilizes the radial key concept but which permits more convenient radial alignment of the keys and associated keyways, and also horizontal leveling.

According to the present invention, there is provided, in combination, a tank and a support system therefor located about a circular horizontal section of the tank, the support system comprising a plurality of essentially identical composite supporting units spaced around the circular horizontal section, with each said supporting unit being joined to the tank and to a base. Each supporting unit has a vertical key with radial contact faces located between and in slidable contact with a pair of opposing vertical faces of the keyway. Also, each supporting unit has a vertical coupling comprising a sleeve with a cylindrical element located therein, with either the sleeve or the cylindrical element stationary on the tank and the other being rotatable about a vertical axis during assembly of the support system. The vertical key or the keyway is joined to whichever of the sleeve or the cylindrical element is rotatable during assembly, and the other of the vertical key or keyway is joined to the base.

Regardless of whether the sleeves or the cylindrical elements are joined stationary on the tank the bottom faces thereof are advisably machined flat to be in about the same horizontal plane to facilitate distributing the tank load uniformly.

When the bottom face of the sleeve is machined it is placed in essentially planar contact with a flat surface on the cylindrical element to distribute the tank load. When the bottom face of the cylindrical element is machined it is placed in essentially planar contact with a flat surface on the sleeve to distribute the tank load.

Radial alignment of each key and cooperating keyway is readily effected when the sleeve is stationary on the tank by marking the coincident radius of each sleeve with that radius of the tank, marking the radius of the cylindrical element parallel to the keyway or the key joined thereto, and placing both such markings in alignment with each other. In a similar way, radial alignment of each key and cooperating keyway is effected when the cylindrical element is stationary on the tank by marking the coincident radius of each cylindrical element with that radius of the tank, marking the radius of the sleeve parallel to the keyway or the key joined thereto, and placing both such markings in alignment with each other.

The invention will be described further in conjunction with the attached drawings, in which.

So far as is practical the same elements or parts which appear in the various views of the drawings will be identified by the same numbers.

FIGS. 1 to 7 of the drawings show a spherical tank 60 and support system therefor in a ship. It is to be understood, however, that the support system may be used equally well on land based tanks, whether spherical or cylindrical or variations thereof which have a circular horizontal section where the support system is joined to the tank.

Figure 1:
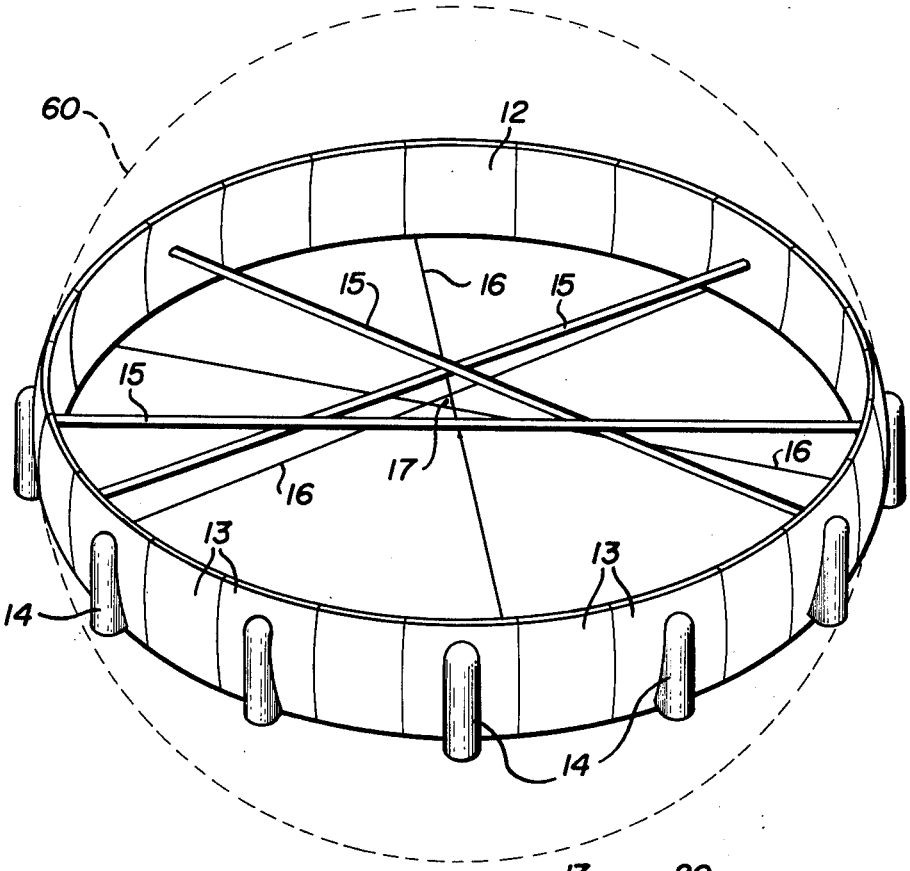
FIG. 1 is an isometric view of a spherical zone or ring shell used in making a spherical tank and shows part of a support system for the tank according to the invention.
Figure 2:
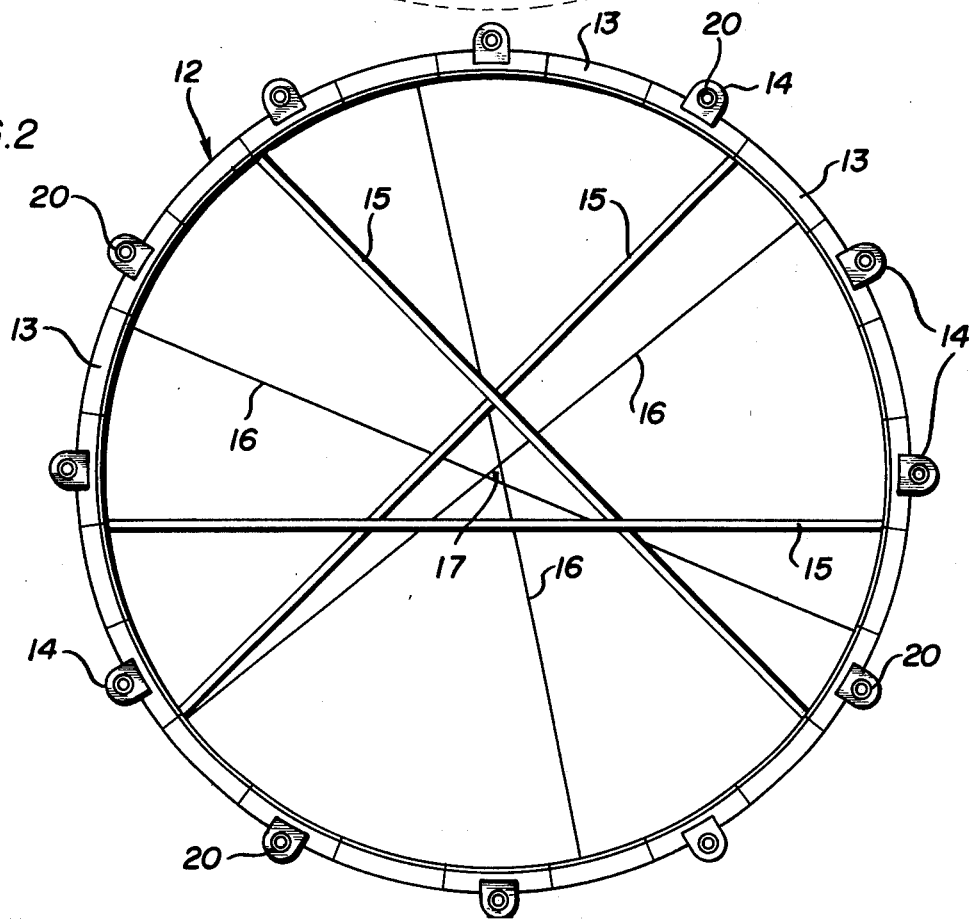
FIG. 2 is a bottom view of the spherical ring shown in FIG. 1.

With reference to FIGS. 1 and 2, a spherical zone or ring 12 is advisably first fabricated by joining together a series of four sided spherical polygon plates 13 having a pair of opposing vertical edges and a pair of opposing horizontal edges. The spherical polygons are joined by welding together abutting vertical edges of adjoining spherical polygon plates 13 to thereby complete the ring. Tank support stub assemblies 14 are prefabricated and then welded in horizontal position to an appropriate spherical polygon plate 13 before the spherical polygon plate is welded into place to form ring 12. This technique facilitates fabrication. A series of rods 15 are positioned approximately diametrically inside of ring 12 to help stiffen the ring. The theoretical center point of the ring 12 is readily located by dividing the circumference of the ring into at least six equal lengths. A minimum of three wires 16 is then stretched from points 180° apart, thus forming a small center triangle. The center 17 of the triangle is then the center of the ring 12. If desired a small plate or the like can be placed on the wires at their triangular intersection and the point 17 marked thereon.

Figure 3:
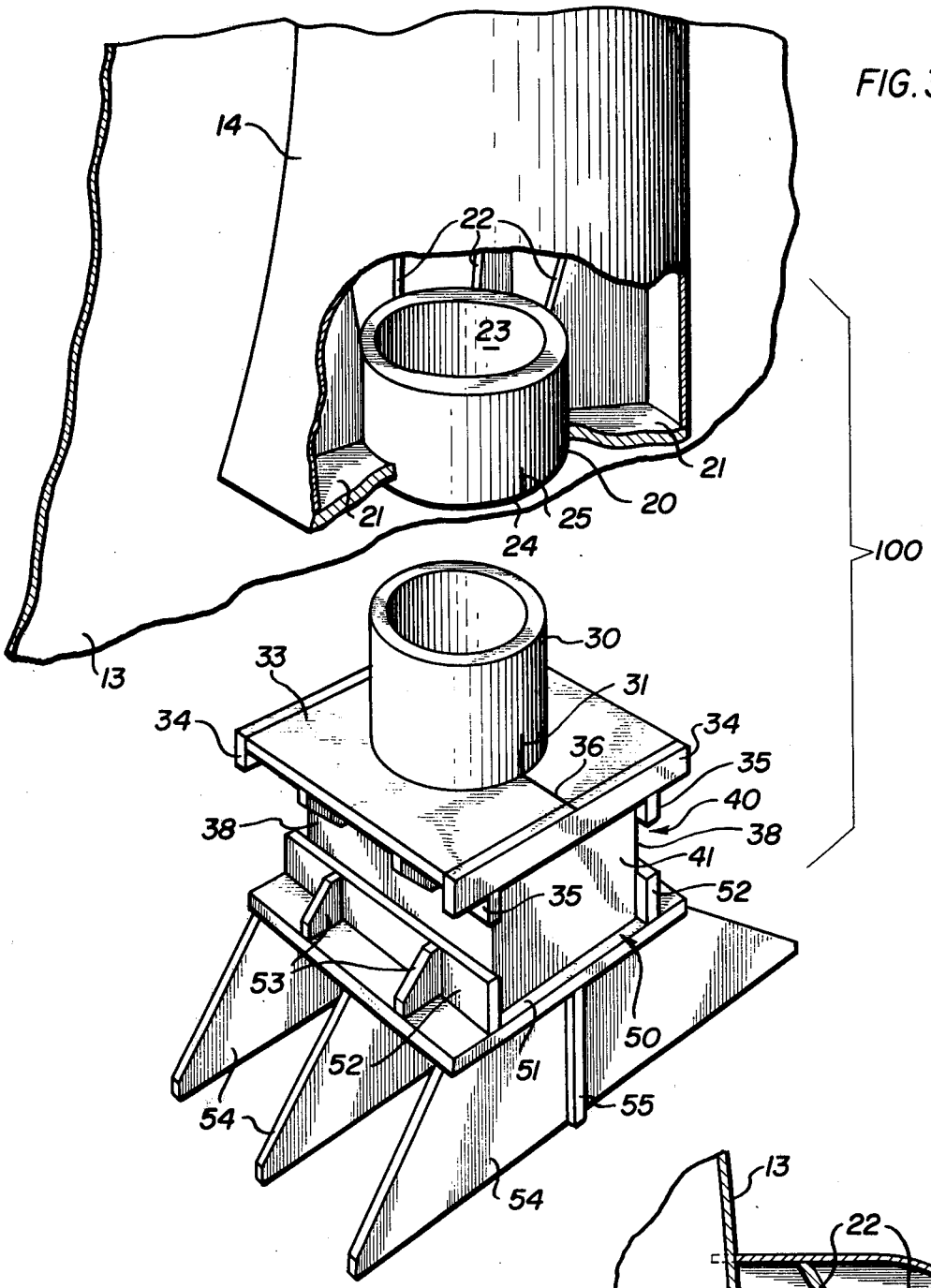
FIG. 3 is an isometric expanded view of a composite supporting unit, a number of which are ultimately placed on the spherical ring shown in FIGS. 1 and 2.
Figure 4:
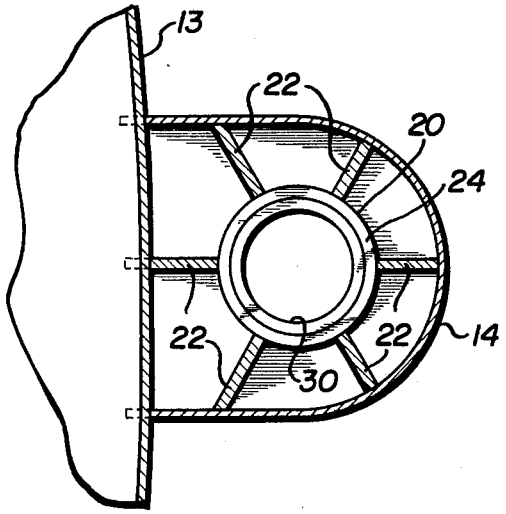
FIG. 4 is a sectional view along the line 4—4 of FIG. 5.
Figure 5:
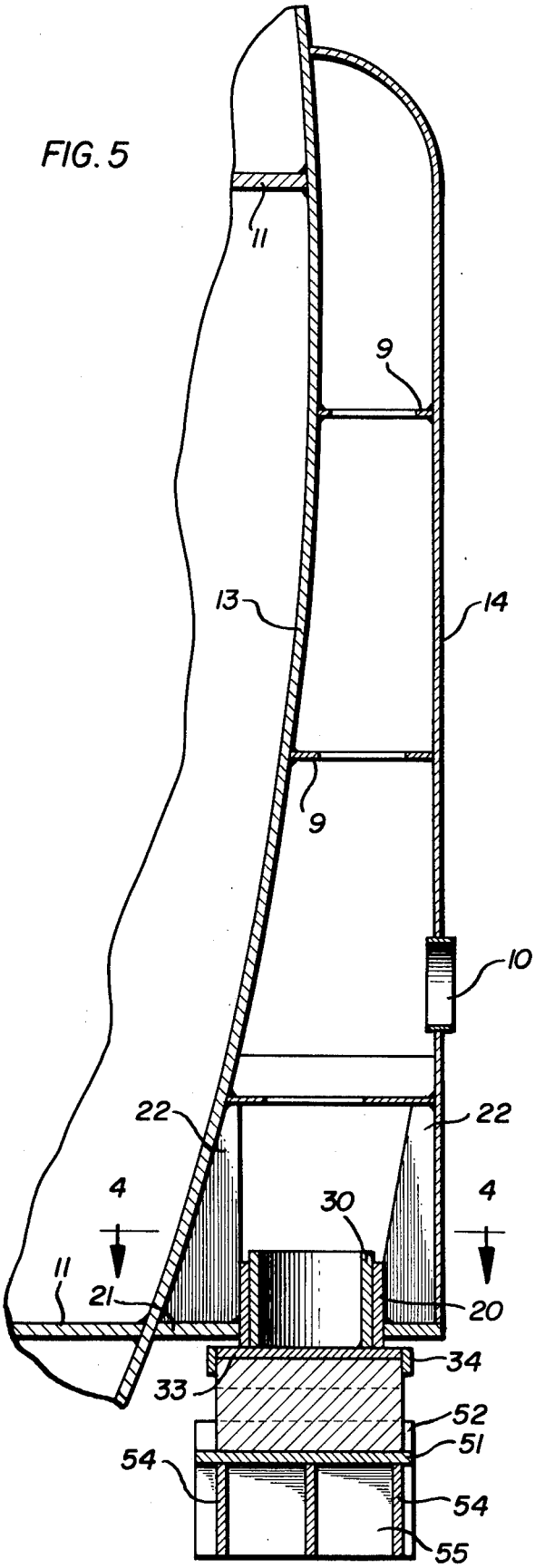
FIG. 5 is a vertical sectional side view of the supporting unit shown in FIGS. 1 to 4.
Figure 6:
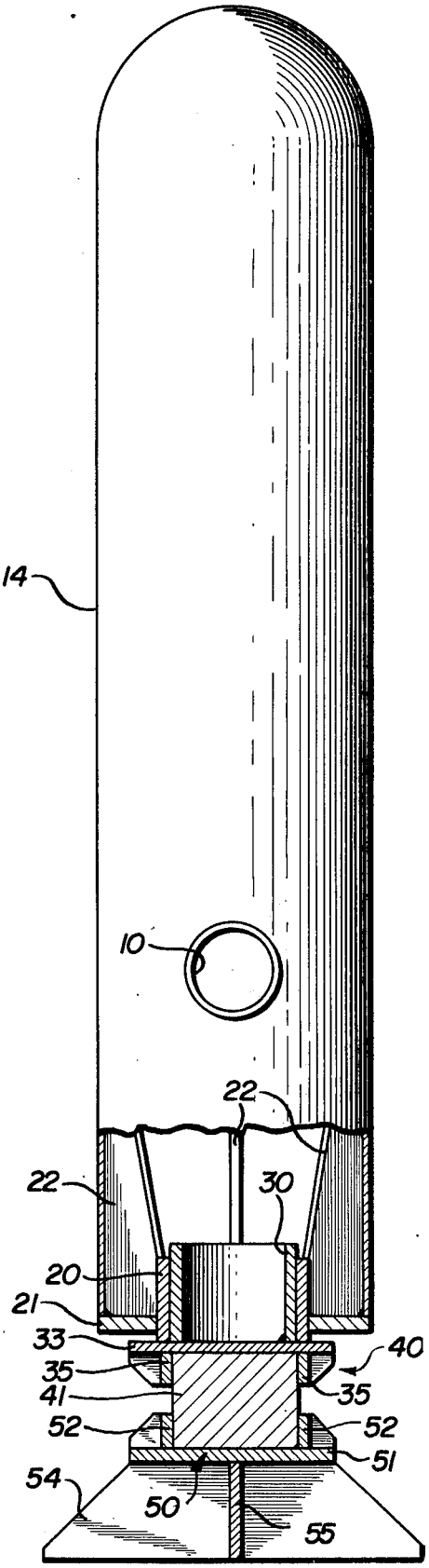
FIG. 6 is a front view, partially in section, of the supporting unit shown in FIG. 5.
Figure 7:
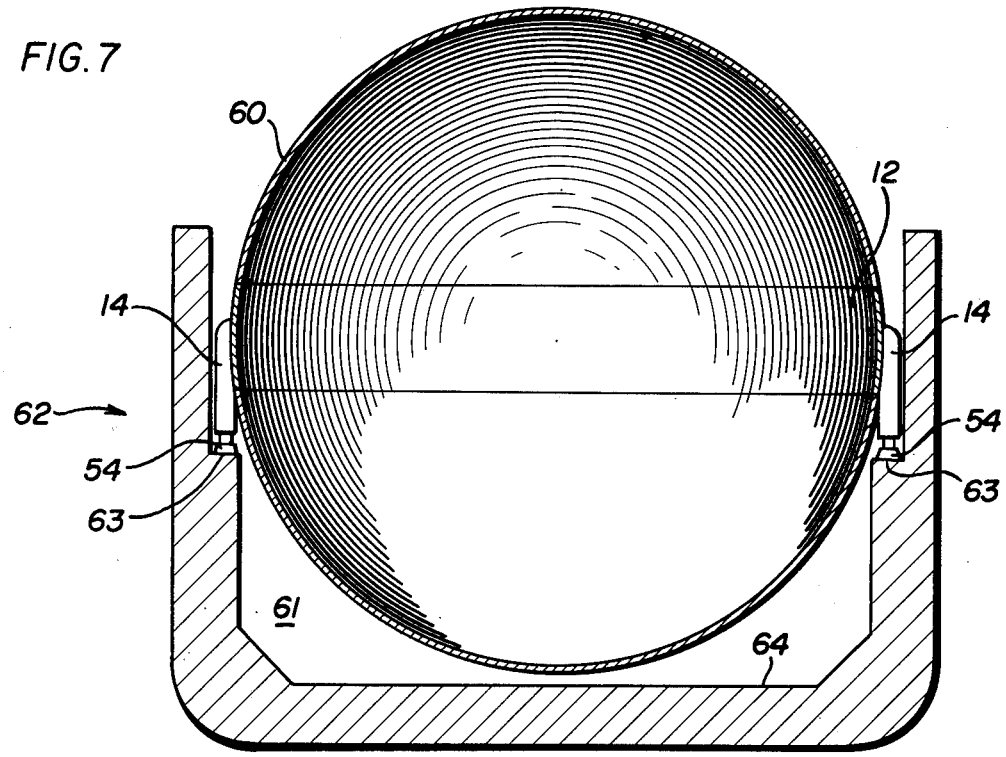
FIG. 7 is a vertical sectional view through the hull of a ship and a spherical tank supported therein by the supporting units shown in FIGS. 1 to 6.

Each stub assembly 14 has a sleeve 20 positioned at the bottom thereof and held securely in place by horizontal plates 21 and vertical plates 22 as is shown in FIGS. 3 and 4. Plates 9, having access holes therein, brace the stub assembly 14. Hole 10 is also provided in stub assembly 14 for access. Girders 11 are placed inside of ring 12 to stiffen it.

Because of the unavoidable distortion which takes place during fabrication of the stub assembly 14 with the sleeve 20 thereon, and the subsequent fabrication of spherical ring 12, it is advisable for the internal surface 23 of sleeve 20, and the bottom face 24 thereof, to be accurately machined. The internal vertical face 23 is machined accurately to a circular cylindrical surface and the bottom face 24 is machined flat and horizontal. The machining is done with the spherical ring 12 as shown in FIG. 1 positioned horizontally. A portable flange facing machine can be attached directly to the lower part of stub assembly 14 and secured inside of sleeve 20 to machine the inside face 23 to be precisely vertical and the bottom surface 24 of the sleeve to be precisely horizontal. All of the axes of all of the cylindrical faces 23 are parallel to each other. All of the bottom surfaces 24 of each of the sleeves 20 is machined to be in the same horizontal plane. After the machining of each sleeve 20 is completed a line is carefully drawn from the theoretical center 17 of spherical ring 12 through the center of the machined circular cylindrical face 23 and to an outer edge of sleeve 20 and a radial marking 25 placed accurately thereon. Each sleeve 20 is marked radially in this way after it is machined as described.

As shown in FIG. 3, each tank supporting unit 100 includes a sleeve 20, cylindrical element 30, key 40 and keyway 50. A weldment is fabricated by welding cylindrical element 30 to plate 33 and welding two spaced-apart opposing side flanges 35 to the lower surface of plate 33. This weldment is then stress relieved and machined. Cylindrical element 30 is then machined externally to a circular cylindrical surface which fits inside of sleeve 20 in precise face contact with machined face 23. The circular cylindrical surface of element 30 is so machined as to be perpendicular to the top surface of plate 33. The top and bottom surfaces of plate 33 are machined parallel to each other and the inside surfaces of flanges 35 are machined parallel to each other and perpendicular to plate 33. A centerline 36 is then scribed between flanges 35. The centerline 36 should also go through a centerline or radial marking 31 placed on cylindrical element 30. Downward projecting end flanges 34 are joined by bolting to opposing side edges of plate 33 to hold the key 40 constituting a load bearing insulating block 41, such as a block of compressed wood impregnated with a resin capable of withstanding low temperatures. The side flanges 35 are placed in contact with the vertical sides of block 41.

Further with reference to FIG. 3, the block 41 constituting key 40 slidably contacts the top surface of horizontal plate 51 forming part of keyway 50. Also forming part of keyway 50 are the guide faces formed by opposing parallel upwardly directed plates 52 which are joined to the top of plate 51. The keyway unit is fabricated by forming a weldment of horizontal plate 51, guide plates 52, braces 53 which reinforce plates 52 and vertical plates 54 and 55 which support plate 51. This weldment is then stress relieved. The top surface of plate 51 is machined horizontal and the inside surfaces of plates 52 are machined parallel to each other and perpendicular to the top surface of plate 51. The plates 52 after machining are dimensioned to be close against the opposing vertical surfaces 38 of block 41. However, the block 41 is free to slide between plates 52 on the upper surface of plate 51 to accommodate expansion and contraction of the spherical tank 60.

After the remainder of the spherical shell is joined to the spherical ring 12 shown in FIG. 1 to form a spherical tank 60 with the completed stub assemblies 14 containing sleeves 20 mounted thereon, each of the cylindrical elements 30 is slid rotatably into a sleeve 20 and the markings 31 and 36 on cylindrical element 30 and plate 33 are aligned with the radial marking 25 to thereby properly align the key 40 and keyway 50 radial to the tank. The cylindrical element 30, key 40 and keyway 50, together with the other elements shown in FIG. 3 are held clamped together with cylindrical element 30 aligned in sleeve 20. The entire tank 60, together with the supporting units positioned as described, is then lifted into the hold 61 of a ship 62 and is positioned so that the bottom edges of plates 54 and 55 rest on a load bearing circular horizontal base or ledge 63 located along the wall of the ship hold 61. The ledge 63 is so located as to position the bottom of the spherical tank 60 above the bottom 64 of the ship hold 61. In this way, the entire weight of the tank and any load therein is borne by the supporting units 100 as previously described.

With the tank positioned in the ship and with the supporting units clamped together as described the lower edges of plates 54 and 55 are measured, cut or burned to size as required, and welded to the ledge 63 with the key and keyway held in a horizontal plane to thereby provide for uniform distribution of the tank load around the supporting ledge in the ship hold. When the tank is so positioned and secured it is free to expand horizontally with temperature change because the bottom surface of key block 41 slides on the upper surface of plate 51 of the keyway. This sliding action is maintained precisely radial to the tank center because of the precise positioning of the coupling elements constituting sleeve 20 and cylindrical element 30 through the radial markings 25, 31 and 36. Furthermore, precise horizontal positioning is achieved because each of the flat or horizontal faces 24 of each sleeve 20 is placed in contact with the flat or horizontal upper surface of plate 33. Any dimensional variations in vertical distance from the top of plate 33 to the bottom of plates 54 and 55 is accommodated for when the bottom edges of plates 54 and 55 are joined, such as by welding, to the surface of ledge 63. Although not shown in the drawings the tank, support system and ship hold may be insulated as needed to carry a low temperature product in the tank.

Although the sliding radial key and keyway support system as described with reference to FIGS. 1 to 7 permits controlled horizontal movement when the tank expands or contracts, it does not provide against upward vertical forces which may develop during rolling and pitching of the ship, or when the tank is empty except for perhaps vapors of a gas such as natural gas which is lighter than air. Various ties can be used to oppose such vertical uplifting forces. Representative tie down systems are disclosed in Miller et al. U.S. Pat. No. 3,908,574.

As previously indicated, a vertical coupling is formed when the cylindrical element 30 is rotatably positioned inside of sleeve 20. It is, of course, feasible for the sleeve 20 to be joined to plate 23 instead of cylindrical element 30, and for cylindrical element 30 to be joined to plate 21 rather than to plate 33. Of course, the appropriate faces of each of these parts would have to be machined accurately in order to obtain the desired precision for the vertical coupling. Furthermore, regardless of whether the cylindrical element 30 or the sleeve 20 is joined to stub assembly 14, it is secured in a stationary manner thereto. Whichever of the parts of the coupling is joined to plate 33 will be rotatably positioned in the other part of the coupling until the tank is securely positioned to rest on ledge 63 and plates 54 and 55 are welded thereto. Once that is done rotation of the cylindrical element relative to the sleeve will not be possible.

It is also within the scope of the invention to transpose the position of the key 40 relative to the keyway 50 in the embodiment shown in FIGS. 1 to 7. For example, the key 40 may be placed below keyway 50. In such an arrangement the keyway would then be joined to whichever of the cylindrical element 30 or sleeve 20 is joined to plate 33.

Figure 8:
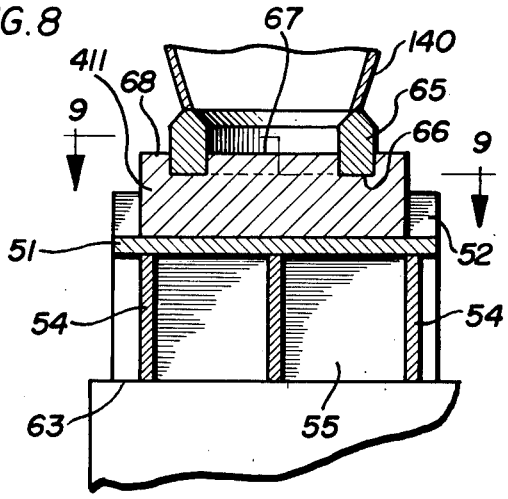
FIG. 8 is a vertical sectional view of the lower part of a second embodiment of vertical coupling which can be used in a supporting unit for a tank.
Figure 9:
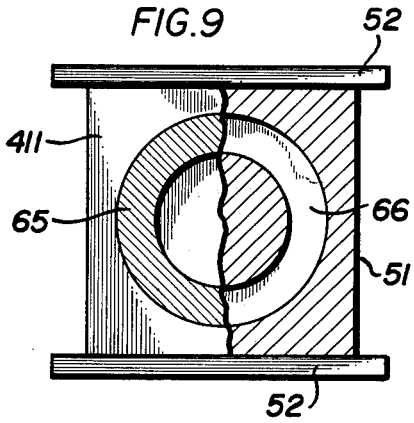
FIG. 9 is a sectional view along the line 9—9 of FIG. 8.

A further embodiment of a vertical coupling according to the invention is illustrated by FIGS. 8 and 9. In this embodiment a plurality of stub assemblies 140 are joined to a spherical ring of the type shown in FIG. 1. Each stub assembly 140 has a sleeve 65 joined at the bottom thereof. The two vertical sides and the bottom face of sleeve 65 are carefully machined to fit in a circular channel 66 machined in key block 411. The cylindrical upper middle part 67 of key block 411 may be considered a cylindrical element which fits inside of sleeve 65 to thereby complete a coupling. From an alternative viewpoint, the annular ring portion 68 at the top of key block 411 may be viewed as a sleeve, in which case the formerly identified sleeve 65 may be viewed as a cylindrical element which fits therein. This embodiment thus illustrates that it is possible to have the cylindrical elements or the sleeves joined to the tank and the other joined to the key-keyway combination. The key block 411 is made of load bearing insulating material and constitutes a key which slides in a keyway formed by the face of plate 51 and the spaced-apart plates 52 as shown in FIG. 9.

Figure 10:
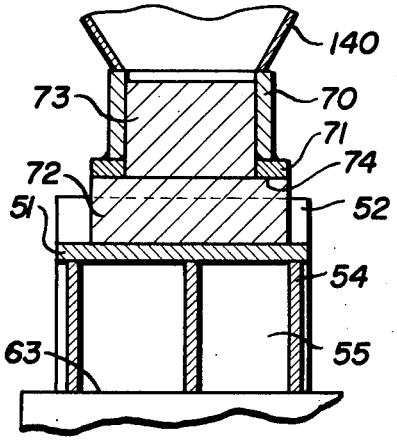
FIG. 10 is a vertical sectional view through a third embodiment of coupling unit forming part of a supporting unit for a tank.

FIG. 10 illustrates a third vertical coupling. Sleeve 70 having a horizontal annular flange 71 at the bottom is joined to the bottom of stub assembly 140. The internal surface of sleeve 70 and the bottom surface of flange 71 forming part of the sleeve are carefully machined after they are positioned on a spherical ring of the type shown in FIG. 1. Key block 72, which has opposing vertical parallel faces, slides on the top surface of plate 51 between a pair of opposing plates 52. The plate 51 and the plate 52 together constitute the keyway. Although this embodiment shows the key block 72 positioned to slide, with the keyway stationary, it is contemplated that these functions may be reversed to have the key block 72 stationary and the keyway joined to a stub assembly on the tank so that it slides rather than the key block. The key block 72 has an upwardly extending circular cylindrical element 73, integrally formed therewith, which is carefully machined to provide a surface which mates with the machined surface inside of sleeve 70. It also has a machine surface 74 which mates with the bottom horizontal surface of flange 71. Suitable radial markings are positioned on sleeve 70 and flange 71, as well as on cylindrical element 73 and key block 72 so that radial alignment may be effected by alignment of the marks.

Figure 11:
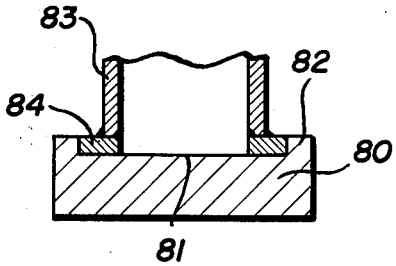
FIG. 11 is a vertical sectional view through an additional embodiment of coupling unit.

An additional embodiment of a coupling is shown in FIG. 11. In this embodiment a key block 80 is machined to form a cylindrical depression 81 therein which results in an upwardly projecting sleeve 82. A cylindrical element 83, which is joined to the tank and which has a bottom flange 84, fits into the cylindrical depression 81 of the key block 80 to thereby complete the coupling. The cylindrical element 83 and flange 84 are radially marked so that the key block 80, which has opposing vertical parallel side faces, may be aligned by a radial marking thereon, running through the center of cylindrical depression 81, placed in alignment with the markings on cylindrical element 83 and flange 84. The key block 80 may be made of a suitable load bearing insulating material such as compressed wood impregnated with a resin.

Figure 12:
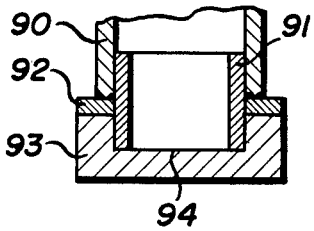
FIG. 12 is a vertical sectional view through a further embodiment of coupling unit.

An additional coupling embodiment is shown in FIG. 12. Sleeve 90 has cylindrical element 91 positioned therein. The sleeve 90 includes a load distributing flange 92 on the lower edge thereof. Key block 93 has a cylindrical bore 94 into which the cylindrical element 91 fits tightly. Radial markings are placed on sleeve 90, cylindrical element 91, flange 92 and key block 93 in order to obtain proper radial alignment of the key block and accompanying keyway in the manner previously described with reference to FIGS. 1 to 7.

It is also within the scope of the invention to make the keyway, as well as the key, of load bearing insulation or to make only the key of insulating material.

The foregoing detailed description has been given for clearness of understanding only, and no unnecessary limitations should be understood therefrom, as modifications will be obvious to those skilled in the art.

What is claimed is:

1. In combination, a tank and a support system located about a circular horizontal section of the tank, the support system comprising a plurality of essentially identical composite supporting units spaced around the circular horizontal section, with each said supporting unit being joined to the tank and to a base, each supporting unit having a vertical key with radial contact faces located between and in slidable contact with a pair of opposing vertical faces of a keyway, each supporting unit having a vertical coupling comprising a sleeve with a cylindrical element located therein, with either the sleeve or the cylindrical element being stationary and the other being rotatable about a vertical axis during assembly of the support system, the vertical key or the keyway being joined to whichever of the sleeve or the cylindrical element is rotatable during assembly and the other of the vertical key or keyway is joined to the base.

2. A combination according to claim 1 in which the sleeve is stationary on the tank and the bottom face of each sleeve is machined flat and to be in about the same horizontal plane.

3. A combination according to claim 1 in which the cylindrical element is stationary on the tank and the bottom face of each cylindrical element is machined to be in about the same horizontal plane.

4. A combination according to claim 2 in which the machined bottom face of the sleeve is in essentially planar contact with a flat surface on the cylindrical element.

5. A combination according to claim 3 in which the machined bottom face of the cylindrical element is in essentially planar contact with a flat surface on the sleeve.

6. A combination according to claim 4 in which a marking for the coincident radius of the sleeve and the tank, and a marking on the radius of the cylindrical element parallel to the keyway or the key joined thereto, are in alignment with each other.

7. A combination according to claim 5 in which a marking for the coincident radius of the cylindrical element and the tank, and a marking for the radius of the sleeve parallel to the keyway or the key joined thereto, are in alignment with each other.

8. A combination according to claim 1 in which the tank is spherical and the support system is located at about the tank equator.

9. A combination according to claim 1 in which the tank is mounted in a ship and the base constitutes a horizontal ledge in the ship hold.

10. A combination according to claim 1 in which the sleeve interior surface and the cylindrical element exterior surface are machined for close mating rotatable contact with each other.

11. A combination according to claim 1 in which the key is made of load bearing insulating material.

12. A combination according to claim 1 in which the keyway is made of load bearing insulating material.

13. In a ship having a spherical tank having a support system located about the equator section of the tank, the support system comprising a plurality of essentially identical composite supporting units spaced around the circular horizontal section, with each said supporting unit being joined to the tank and to a base, each supporting unit having a vertical key with radial contact faces located between and in slidable contact with a pair of opposing vertical faces of a keyway, each supporting unit having a vertical coupling comprising a sleeve joined stationary to the tank and with a cylindrical element located rotatably in the sleeve about a vertical axis during assembly of the support system, and with the bottom face of each sleeve machined flat to be in about the same horizontal plane, the vertical key being joined to the cylindrical element and the vertical keyway being joined to the base; and with a marking for the coincident radius of the sleeve and the tank, and a marking on the radius of the cylindrical element parallel to the keyway and the key, in alignment with each other.

14. A ship according to claim 13 in which the key is load bearing insulating material slidable in the keyway.

* * * * *